US009486073B2

(12) United States Patent
Hopkins et al.

(10) Patent No.: US 9,486,073 B2
(45) Date of Patent: Nov. 8, 2016

(54) METHODS AND DEVICES FOR UNDER-CABINET STORAGE

(71) Applicant: Excede Designs, LLC, Cedar Park, TX (US)

(72) Inventors: Timothy Paul Hopkins, Round Rock, TX (US); Michael William Allen, Cedar Park, TX (US)

(73) Assignee: Excede Designs, LLC, Cedar Park, TX (US)

( * ) Notice: Subject to any disclaimer, the term of this patent is extended or adjusted under 35 U.S.C. 154(b) by 0 days.

(21) Appl. No.: 14/602,719

(22) Filed: Jan. 22, 2015

(65) Prior Publication Data

US 2015/0201750 A1 Jul. 23, 2015

Related U.S. Application Data

(60) Provisional application No. 61/930,939, filed on Jan. 23, 2014, provisional application No. 61/990,631, filed on May 8, 2014, provisional application No. 62/048,801, filed on Sep. 11, 2014.

(51) Int. Cl.
*A47B 96/06* (2006.01)
*A47B 73/00* (2006.01)
(Continued)

(52) U.S. Cl.
CPC ..... *A47B 73/008* (2013.01); *A47B 43/003* (2013.01); *A47B 45/00* (2013.01); *A47B 77/14* (2013.01); *A47B 96/027* (2013.01); *A47B 73/004* (2013.01); *Y10T 29/49826* (2015.01)

(58) Field of Classification Search
CPC .... A47B 73/008; A47B 45/00; A47B 77/14; A47B 77/16; A47B 77/18; A47B 96/06; A47B 96/067; A47B 96/14; A47B 96/1408; A47B 96/145; A47B 96/1458; A47B 96/1466; A47B 96/1475; A47B 96/027; A47B 96/02; A47B 96/024; A47B 96/025; A47B 47/00; A47B 47/021; A47B 47/022; A47B 57/06; A47B 57/16; A47B 57/20; A47B 57/40; A47B 57/406; A47B 57/48; A47F 5/103; A47F 3/06; A47F 5/0018; A47F 5/0025; A47F 5/0043; A47F 5/08; A47F 5/0807; A47F 5/10; A47F 5/101; A47F 7/00
USPC ..... 211/41.2, 59.2, 74, 85.29, 162, 75, 117, 211/90.01, 90.02, 97–103, 175, 190, 204, 211/206, 207, 86.01, 88.01; 312/140.1–140.4; 248/200.1, 201
See application file for complete search history.

(56) References Cited

U.S. PATENT DOCUMENTS 574,509 A * 1/1897 Welter ..... A47F 5/103 211/106.01
1,358,332 A * 11/1920 Rodwell ..... A47B 77/16 211/76

(Continued)

FOREIGN PATENT DOCUMENTS

DE 297 03 285 4/1997
DE 203 00 351 6/2003

(Continued)

OTHER PUBLICATIONS

"Bath Toy Organisation," http://ourfourwallsandaroof.blogspot.com/, 2014.

(Continued)

*Primary Examiner* — Babajide Demuren
(74) *Attorney, Agent, or Firm* — Parker Highlander PLLC

(57) ABSTRACT

Methods and devices for under-cabinet storage are disclosed herein.

11 Claims, 13 Drawing Sheets

(51) Int. Cl.

| | |
|---|---|
| ***A47B 45/00*** | (2006.01) |
| ***A47B 77/14*** | (2006.01) |
| ***A47B 43/00*** | (2006.01) |
| ***A47B 96/02*** | (2006.01) |

(56) References Cited

U.S. PATENT DOCUMENTS

| | | | | | |
|---|---|---|---|---|---|
| 1,627,241 | A | | 5/1927 | Johnson | |
| 1,857,522 | A | * | 5/1932 | Ungeheuer | A47B 13/16 108/26 |
| 2,485,067 | A | | 10/1949 | Roberts | |
| 2,839,349 | A | * | 6/1958 | Culver | A47B 88/06 312/323 |
| 2,937,768 | A | * | 5/1960 | Davis | A47F 7/30 211/175 |
| 3,007,580 | A | * | 11/1961 | Dickson, Jr. | A47F 1/121 211/59.3 |
| 3,058,595 | A | | 10/1962 | Morris | |
| 3,123,219 | A | | 3/1964 | Jones | |
| 3,372,632 | A | * | 3/1968 | Stalker | F24C 15/2071 126/299 D |
| 3,464,749 | A | * | 9/1969 | Bishop | A47B 77/10 312/242 |
| 3,485,544 | A | * | 12/1969 | Beckerman | A47B 46/005 312/245 |
| 3,712,696 | A | * | 1/1973 | McDonnell | A47B 67/04 211/88.01 |
| 3,953,093 | A | * | 4/1976 | Hero | A47B 77/02 312/245 |
| 4,150,629 | A | * | 4/1979 | Santi | A47J 47/16 108/60 |
| 4,436,352 | A | * | 3/1984 | Okada | A47B 77/16 312/228 |
| 4,494,661 | A | | 1/1985 | Krusche | |
| 4,700,849 | A | * | 10/1987 | Wagner | A47B 73/00 211/113 |
| 4,756,582 | A | * | 7/1988 | Heien | A47L 19/04 211/41.4 |
| 4,915,461 | A | * | 4/1990 | Kingsborough | A47B 77/10 312/247 |
| 5,244,272 | A | * | 9/1993 | Thompson | A47B 88/06 211/74 |
| 5,255,818 | A | * | 10/1993 | Zeigler | A47J 47/01 221/45 |
| 5,720,547 | A | * | 2/1998 | Baird | A47B 87/008 220/552 |
| 5,743,438 | A | * | 4/1998 | Sokolnicki | B67D 1/06 211/113 |
| 6,299,267 | B1 | * | 10/2001 | Butters | A47B 77/10 108/143 |
| 6,371,584 | B1 | * | 4/2002 | Alreck | A47B 67/04 177/144 |
| 6,755,492 | B1 | * | 6/2004 | Hyde | A47B 51/00 312/247 |
| 7,100,882 | B2 | * | 9/2006 | Behroozi | A47B 23/04 248/317 |
| 8,016,132 | B2 | * | 9/2011 | LaRiviere | A47G 23/0208 211/85.29 |
| 2002/0109444 | A1 | * | 8/2002 | Webb | A47B 96/025 312/313 |
| 2004/0007548 | A1 | * | 1/2004 | Tilly | A47B 77/16 211/74 |
| 2004/0099622 | A1 | * | 5/2004 | Lee | A47F 7/283 211/85 |
| 2005/0237732 | A1 | | 10/2005 | Lagman et al. | |
| 2009/0084741 | A1 | * | 4/2009 | Gray | A47B 81/04 211/70 |
| 2013/0181587 | A1 | * | 7/2013 | de heer Sagoo | A47B 77/16 312/307 |

FOREIGN PATENT DOCUMENTS

| | | | |
|---|---|---|---|
| FR | 2 743 479 | | 7/1997 |
| JP | 05293020 | A * | 11/1993 |

OTHER PUBLICATIONS

"Hafele Backsplash Rail System," downloaded at http://www.houzz.com/photos/4423750/Hafele-Backsplash-Rail-System--cabinet-and-drawer-organizers-other-metro, 2014.

"Modular Pole Shelving blog + pogohome," downloaded at http://theblogonthebookshelf.blogspot.com/2008/06/modular-pole-shelving-blog-pogohome.html, 2014.

* cited by examiner

METHODS AND DEVICES FOR UNDER-CABINET STORAGE

CROSS-REFERENCE TO RELATED APPLICATIONS

This application claims priority to U.S. Provisional Patent Application Ser. No. 61/930,939 filed Jan. 23, 2014, U.S. Provisional Patent Application Ser. No. 61/990,631 filed May 8, 2014 and U.S. Provisional Patent Application Ser. No. 62/048,801 filed Sep. 10, 2104, each of which are incorporated by reference herein.

FIELD OF THE INVENTION

Embodiments of the present invention relate to methods and devices for under-cabinet storage.

BACKGROUND

The following descriptions and examples are not admitted to be prior art by virtue of their inclusion within this section.

Within the home storage industry for kitchens, or other rooms, storage products typically use similar mounting methods, including for example freestanding on a counter top, mounting to a wall (including, for example, a backsplash) or under cabinets using fasteners or adhesive, or suspended from ceilings. These methods either take use additional counter space or require permanent modifications or marring of mounting surfaces. Additionally, few existing products offer the ability to interchange attachments depending on the items that need to be stored.

In certain instances, it can be desirable to provide for under-cabinet storage that does not permanently attach to a cabinet or counter. For example, if the user is renting the property in which the storage is desired, it may not be permissible to attach devices to the cabinets or counters in a manner that damages the cabinet or counter surface. While damage to cabinets, walls, or countertops is especially important to those who rent their homes or spaces, this could also be seen as a significant advantage for homeowners interested in adding storage and freeing counter space to their own homes. For example, a homeowner may wish to temporarily provide for under-cabinet storage, or have the flexibility to move the storage device from one location to another location under the cabinets.

Exemplary embodiments as disclosed herein provide for methods and devices for under-cabinet storage that address these and other shortcomings of existing devices and methods.

SUMMARY OF THE INVENTION

Exemplary embodiments of the present disclosure relate to methods and devices for under-cabinet storage. Exemplary embodiments can be secured in place without the need for hardware or significant use of counter space. Certain embodiments can be installed quickly and easily by using the back corner of counter tops and the face frame over-hang of the upper cabinets. Certain embodiments can also be adjustable or fixed for different cabinet depth and mounting height. Using mounting methods disclosed herein, users can increase their available storage while clearing counter space for other uses. Exemplary mounting methods do not require fastening to cabinets, walls, or countertop, and certain exemplary devices can be easily removed for relocation without damaging cabinet surfaces, such as leaving behind fastener holes.

Exemplary embodiments include a method of supporting a storage device, the method comprising: engaging the storage device with a surface of a cabinet; and engaging the storage device with a horizontal surface underneath the cabinet, where the storage device does not penetrate the surface of the cabinet, and the storage device does not penetrate the horizontal surface. In certain embodiments of the method, the surface of the cabinet is perpendicular to the horizontal surface. In particular embodiments of the method, the surface of the cabinet perpendicular to the horizontal is a face frame of the cabinet. In some embodiments of the method, the surface of the cabinet is parallel to the horizontal surface. In specific embodiments of the method, the storage device comprises a transverse member coupled to a support member. In certain embodiments of the method, the support member comprises a vertical component and a lateral component. In particular embodiments of the method, the vertical and/or lateral component of the support member is adjustable in length.

In certain embodiments of the method, the angle between the lateral component and the vertical component of the support member is greater than or equal to 90 degrees. In some embodiments of the method, the lateral component of the support member is flexibly coupled to the vertical component of the support member. Specific embodiments of the method further comprise engaging the storage device with a wall extending between the cabinet and the horizontal surface.

Exemplary embodiments also comprise an under-cabinet storage device comprising: a first support member; a second support member; and a first transverse member extending between the first support member and the second support member. In certain embodiments, the first end support member and the second end support member each comprise a vertical component and a lateral component, where the vertical component is adjustable in length and the lateral component is adjustable in length. Particular embodiments further comprise a second transverse member. In some embodiments, a transverse member comprises a storage rack. In specific embodiments, a transverse member comprises a plurality of polygon shaped apertures configured to receive a circular neck of a bottle and support the bottle. In particular embodiments, each aperture in the plurality of apertures comprises a polygon shape. In certain embodiments, the polygon shape comprises at least four sides and at least four corners, and in specific embodiments each aperture is configured such that a corner of the polygon shape is a lowermost point of the polygon shape.

In some embodiments, each aperture is configured to receive a circular neck of a bottle and support the bottle. In specific embodiments, each aperture is configured to support the bottle such that the bottle is substantially horizontal when supported by an aperture. Certain embodiments further comprise a second transverse member extending between the first end support member and the second end support member. In specific embodiments the first transverse member is adjustable in length, such that the distance between the first end support member and the second end support member is adjustable.

In certain embodiments, the vertical component of the first end support member and the horizontal component of the first end support member are in parallel to a first plane; the vertical component of the second end support member and the horizontal component of the second end support member are parallel to a second plane; the vertical component of the first end support member, the transverse member, and the vertical component of the second end support member are parallel to a third plane; the first plane and the second plane are parallel; and the third plane is perpendicular to the first plane and perpendicular to the second plane.

Exemplary embodiments also include an under-cabinet storage device comprising: a first end support member; a second end support member; and a transverse member extending between the first end support member and the second end support member. In particular embodiments, the first end support member and the second end support member each comprise: a vertical component; a lateral component; and a flexible component coupling the vertical component and the lateral component. In certain embodiments, the flexible component is biased to a first position in which the vertical component and the lateral component are positioned such that a first angle between the vertical component and the lateral component is equal to or greater than 90 degrees; and the flexible component can be moved to a second position in which the vertical component and the lateral component are positioned such that a second angle between the vertical component and the lateral component is less than the first angle.

In particular embodiments, the first end support member and the second end support member are adjustable in length. In some embodiments, the vertical component, the lateral component and the flexible component of the first and second end support members are comprised in a unitary flexible component. In specific embodiments, an adjustable length component is used in conjunction with the unitary flexible component. In certain embodiments, the unitary component is a flat bar, including for example a plastic or metal flat bar. In particular embodiments, the vertical component of the first end support member and the vertical component of the second end support member are adjustable in length. In some embodiments, the lateral component of the first end support member and the lateral component of the second end support member are adjustable in length. In specific embodiments, the lateral member extending between the first end support member and the second end support member is adjustable in length. In certain embodiments, the transverse member comprises a storage rack. In particular embodiments, the transverse member comprises a plurality of polygon shaped apertures configured to receive a circular neck of a bottle and support the bottle. In some embodiments, the polygon shape comprises at least four sides and at least four corners. In specific embodiments, each aperture is configured such that a corner of the polygon shape is a lowermost point of the polygon shape.

The term "coupled" is defined as connected, although not necessarily directly, and not necessarily mechanically. Two items are "coupleable" if they can be coupled to each other, and, when coupled, may still be characterized as "coupleable." Unless the context explicitly requires otherwise, items that are coupleable are also decoupleable, and vice-versa. One non-limiting way in which a first structure is coupleable to a second structure is for the first structure to be configured to be coupled (or configured to be coupleable) to the second structure.

The terms "a" and "an" are defined as one or more unless this disclosure explicitly requires otherwise.

The term "substantially" and its variations (e.g., "approximately" and "about") are defined as being largely but not necessarily wholly what is specified (and include wholly what is specified) as understood by one of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. For example, a system that comprises two members may have more than two members.

Furthermore, a device or structure that is configured in a certain way is configured in at least that way, but may also be configured in ways that are not listed. Metric units may be derived from the English units provided by applying a conversion and rounding to the nearest millimeter.

The feature or features of one embodiment may be applied to other embodiments, even though not described or illustrated, unless expressly prohibited by this disclosure or the nature of the embodiments.

Any embodiment of any of the disclosed devices and methods can consist of or consist essentially of—rather than comprise/include/contain/have—any of the described elements and/or features and/or steps. Thus, in any of the claims, the term "consisting of" or "consisting essentially of" can be substituted for any of the open-ended linking verbs recited above, in order to change the scope of a given claim from what it would otherwise be using the open-ended linking verb. In addition, the recitation of steps in a method does not require that the steps be performed in the order recited.

Other features and associated advantages will become apparent with reference to the following detailed description of specific embodiments in connection with the accompanying drawings.

BRIEF DESCRIPTION OF THE DRAWINGS

The following drawings illustrate by way of example and not limitation. For the sake of brevity and clarity, every feature of a given structure may not be labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1:
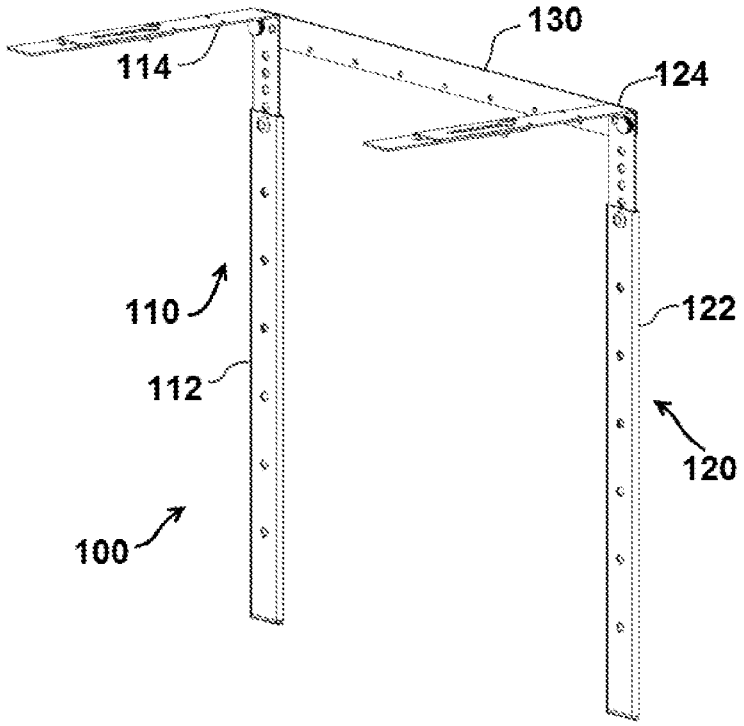
FIG. 1 is a perspective view of an embodiment of a storage device according to the present disclosure.

FIG. 1 is a perspective view of an exemplary embodiment of an under-cabinet storage device 100 according to the present disclosure. In the embodiment shown, device 100 comprises a first support member 110, a second support member 120 and a first transverse member 130 coupled to and extending between first support member 110 and second support member 120.

In this embodiment, first support member 110 comprises a vertical component 112 and a lateral component 114, while second support member 120 comprises a vertical component 122 and a lateral component 124. In the embodiment shown, vertical components 112, 122 and lateral components 114, 124 are adjustable in length. It is understood that in other embodiments, the vertical and lateral components of the support members may be fixed length. In certain embodiments, rack attachments and/or other storage components (including for example hooks, and in particular banana hooks) can be coupled to lateral components 114, 124.

Figure 2:
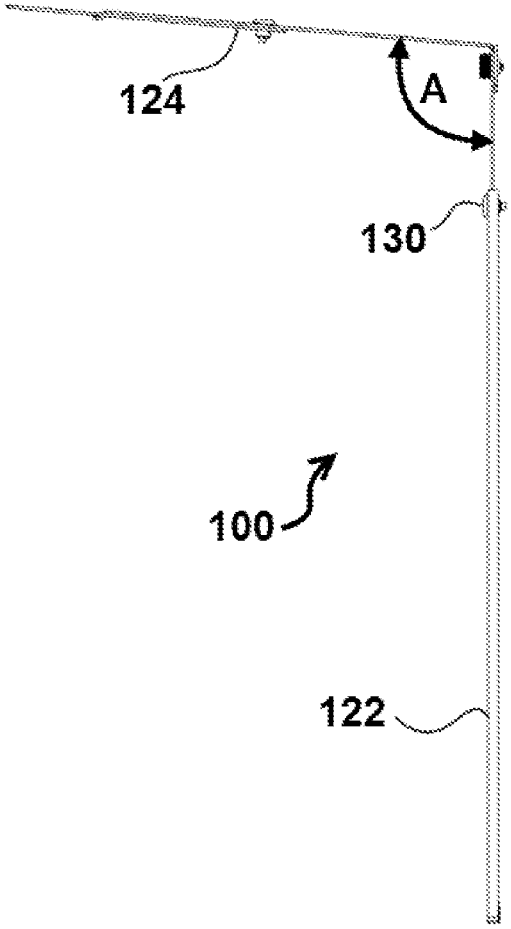
FIG. 2 is a side view of the embodiment of FIG. 1.

In the side view shown in FIG. 2, it can be seen that the angle A between vertical component 122 and lateral component 124 is greater than 90 degrees when there is no force being applied to lateral components 122 and 124. The angle between vertical component 112 and lateral component 114 (which are not visible from this view) is also greater than 90 degrees. It is understood that the angle between the components shown in FIG. 2 is merely exemplary of one embodiment, and other embodiments may include an angle of approximately 90 degrees between components 122 and 124 (as well as between 112 and 114). In the embodiment shown, lateral components 114 and 124 are coupled to vertical components 112 and 122 in a flexible manner such that the angle between the lateral and vertical components can be decreased.

Figure 3:
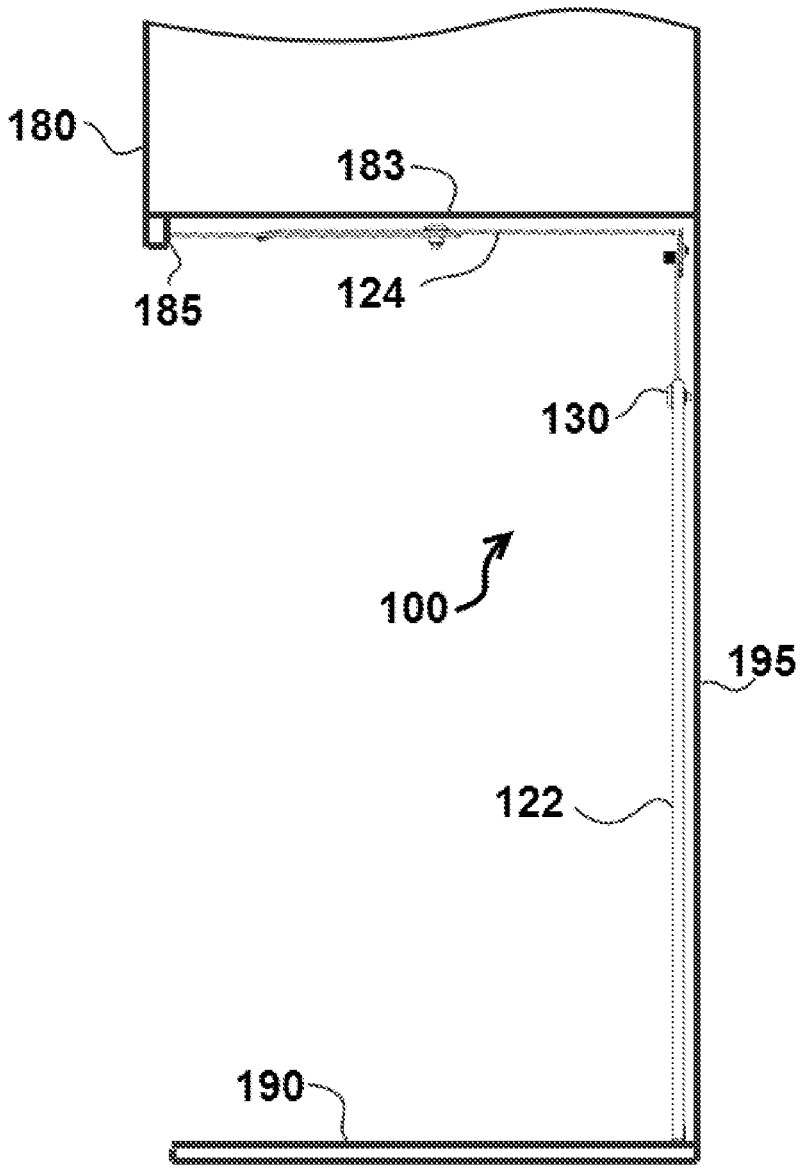
FIG. 3 is a side view of the embodiment of FIG. 1 during use.

For example, FIG. 3 illustrates a side view of the embodiment of FIGS. 1 and 2 during use. The flexible nature of the coupling between the lateral components 114, 124 and vertical components 112, 122 can allow device 100 to be supported under a cabinet 180 and above a horizontal surface 190 (e.g. a counter top or other surface generally perpendicular to a vertical surface or wall 195 behind cabinet 180) without permanently attaching device 100 to either cabinet 180 or horizontal surface 190. In the embodiment shown, vertical components 112, 122 are engaged with horizontal surface 190. In addition, lateral components 114, 124 are positioned such that they are approximately perpendicular to vertical components 112, 122 and parallel to a bottom surface 183 of cabinet 180 in this embodiment. In other embodiments, the angle between lateral components 114, 124 and vertical components 112, 122 can still be greater than 90 degrees when device 100 is installed under cabinet 180. Lateral components 114, 124 engage a surface of cabinet 180 (e.g. a face frame 185) without penetrating the surface cabinet 180. In the position shown in FIG. 3, device 100 can support items (e.g. kitchen utensils) from transverse member 130 without permanent attachment to either cabinet 180 or horizontal surface 190. The weight of items supported by transverse member 130 will not cause device 100 to tilt away from a wall 195 extending between cabinet 180 and horizontal surface 190. For example, the engagement of lateral components 114, 124 with face frame 185 will counteract a tendency of device 100 to tilt away from wall 195.

Device 100 can also be removed from under cabinet 180 without causing damage to either cabinet 180 or horizontal surface 190. For example, a user can exert a downward force on lateral components 114, 124 so that the angle between the lateral members and vertical components 112, 122 is less than 90 degrees and lateral components 114, 124 are no longer engaged with face frame 185. This can allow device 100 to be tilted away from wall 195 and removed from the area between cabinet 180 and horizontal surface 190. In certain embodiments, a user may adjust the length of lateral components 114, 124 to less than the distance between face frame 185 and wall 195, thereby allowing device 100 to be tilted away from wall 195 and removed from the area between cabinet 180 and horizontal surface 190. A user may also remove device 100 by pulling a lower portion of vertical components 112 and 122 away from wall 195.

It is understood that the embodiment shown in FIG. 3 is just one example of embodiments of devices and methods of use according to the present disclosure. For example, the support members and transverse member(s) may include different configurations than that shown in FIG. 3. In addition, the methods of engagement with cabinet 180 and horizontal surface 190 may also be different. For example, the support members may comprise spring-loaded or compressible (e.g. rubber) components to facilitate engagement with cabinet 180 and horizontal surface 190 and ease of removal of device 100. Non-limiting examples of additional configurations for support members and transverse members are also provided in the discussion of additional figures below.

In addition to providing easy removal without damage to the surrounding structure, device 100 also provides other benefits. For example, device 100 also allows for storage of items on horizontal surface 190 because vertical components 112, 122 engage horizontal surface 190 in an area proximal to wall 195 (e.g. within 1 inch or less of wall 195). In certain embodiments, vertical components 112, 122 are in contact with wall 195 and therefore minimize any intrusion into horizontal surface 190. This can allow horizontal surface 190 to be used for storage of other items, as well as activities such as food preparation.

Figure 4:
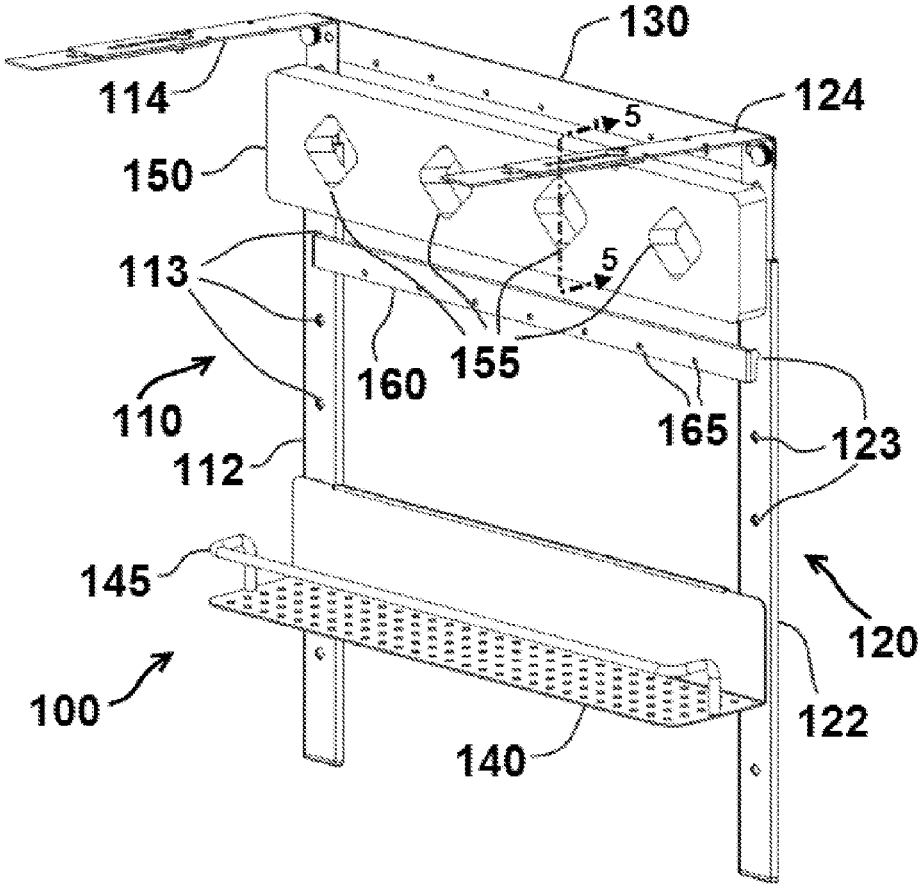
FIG. 4 is a perspective view of the embodiment of FIG. 1 with additional components.

In certain embodiments, storage device 100 may also comprise additional transverse members extending between first and second support members 110 and 120. For example, the embodiment shown in FIG. 4 comprises a second transverse member 140, a third transverse member 150 and a fourth transverse member 160. In this embodiment, second transverse member 140 is configured as a shelf with a retaining bar 145, suitable for holding small items such as spice containers, cups, glasses, fruit, personal articles, etc. Exemplary embodiments may comprise transverse members configured as attachments in any number of configurations, including for example: (1) Wine bottle holder, (2) Glassware rack (e.g. wine glasses, beer mugs, coffee mugs, etc.), (3)

Miscellaneous racks that store; paper towel holder, hooks for glassware, fruit, knives or other kitchen utensils, (4) Spice rack that holds spice bottles and/or pinch bowls with cover, (5) Picture frames, (6) Magnetic strip for kitchen utensils, (7) Cork, chalk, marker boards, (8) Metal for magnets, (9) "Tupperware" container holder, (10) Box wine holder, (11) Baby bottle holder and/or dryer, (12) Knife block, (13) Metal sheet and magnets for holding pictures, notes, artwork, etc., (14) Tablet, mobile phone, or recipe book holder, (15) Magnet strip for spice bottles, (16) Metal strip for spice bottles with magnets, (17) Holder/dispenser for individual beverage making cups or packets (such as "K-Cups" or tea bags), (18) Fruit shelf or basket/bowl, (18) Glass or cup holder/dryer, (19) Dish drying rack, (20) Device charging station for tablet, phone, etc., (21) Pinch bowl holder, (22) Wrap roll holder (foil, wax paper, etc.), (23) Hanging plants or shelves for plants, (24) Stationary holders for notepads, books, mail, writing utensils, etc., (25) Mounting for TV's using VESA mounting or other method, (26) Music, speaker, radio, portable audio, or camera holder, or any combination thereof, (27) Cutting board holder, (28) Back Panel; blank or Peg Board, (29) Cross Member for support and/or (30) Charging shelf for cell phones and tablets.

Figure 5A:
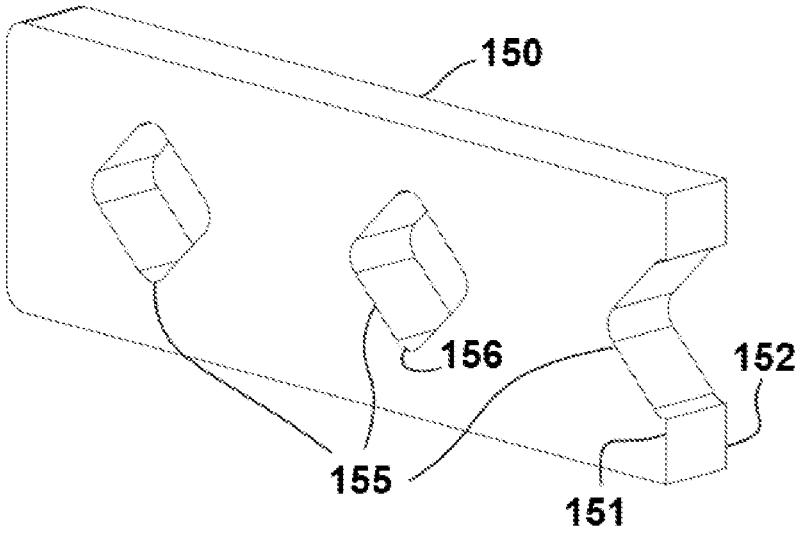
FIGS. 5A and 5B are perspective section views taken along line 5-5 in FIG. 4.
Figure 5B:
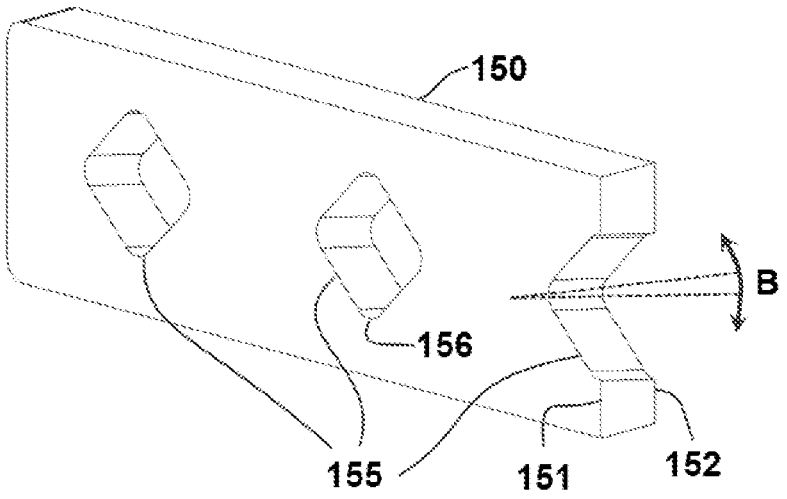

In the embodiment shown, third transverse member 150 comprises a plurality of apertures 155 configured with a polygon shape. In the specific embodiment shown, apertures 155 are configured in a square shape with a corner of the square at a lowermost point of the aperture. As discussed in more detail below, such a configuration is configured to receive a circular neck of a bottle (including, for example, a wine, oil, or liquor bottle) and support the bottle such that the bottle is substantially horizontal. FIGS. 5A and 5B illustrate a perspective section view of transverse member 150 taken at line 5-5 in FIG. 4. In the embodiment shown in FIG. 5A, aperture 155 extends through transverse member 150 substantially perpendicular to surfaces 151 and 152. In the embodiment shown in FIG. 5B, aperture 155 extends through transverse member 150 at an angle B (e.g. approximately 10 degrees from horizontal when surfaces 151 and 152 are vertical). Such configurations can allow the bottle to maintain a substantially horizontal position when aperture 155 is larger than the neck of the bottle inserted into the aperture. This configuration can therefore allow a fluid (e.g. wine) within the bottle to maintain contact with a seal (e.g. a cork) during storage which can be important for maintaining an effective seal of the bottle.

As shown in FIGS. 5A and 5B, the polygon shape and orientation of apertures 155 also provides additional advantages for storage of bottles. By providing a polygon shape with a corner 156 at a lowermost point of the aperture, the bottles are restricted from moving from side-to-side or rolling within aperture 155. The force of gravity will direct the neck of the bottle toward corner 156 of the polygon, and the sides of the polygon configuration secure the bottle from side-to-side movement. A circular opening, in contrast, would allow the neck of the bottle to roll from side to side. The polygon shape can also allow different size bottle necks to be securely retained, as the aperture can be larger than the bottle neck and still securely retain it by virtue of the angled sides. While square or diamond shapes are shown in FIGS. 5A and 5B, it is understood that other shapes can be utilized, including for example, circles, ellipses, triangles, pentagons, and hexagons.

Referring back now to FIG. 4, fourth transverse member 160 comprises a plurality of apertures 165 configured for receiving hooks or other supporting devices that can be used to hang items including, for example, kitchen utensils. In certain embodiments, the transverse members extending between first and second support members 110, 120 are adjustable in length such that the distance between first and second support members 110, 120 can be increased or decreased.

In this embodiment of storage device 100, vertical components 112 and 122 comprise a plurality of apertures 113 and 123 configured to receive transverse members 140 and 150. In this embodiment, the back sides of transverse members 140 and 150 can each comprise hooks or pegs (not visible in the figures) that can be inserted into apertures 113 and 123 to adjust the location of transverse members 140 and 150.

Figure 6:
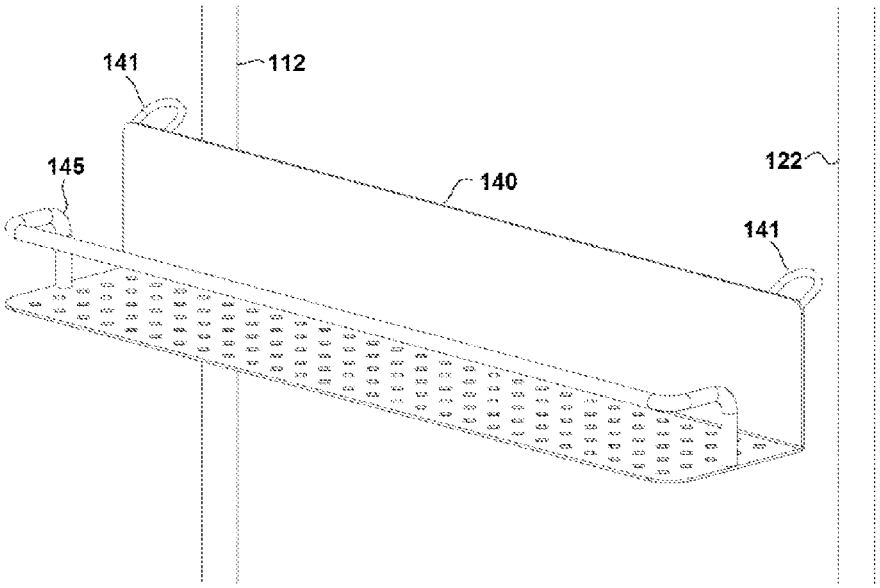
FIG. 6. is a perspective view of a component of the embodiment of FIG. 4.
Figure 7:
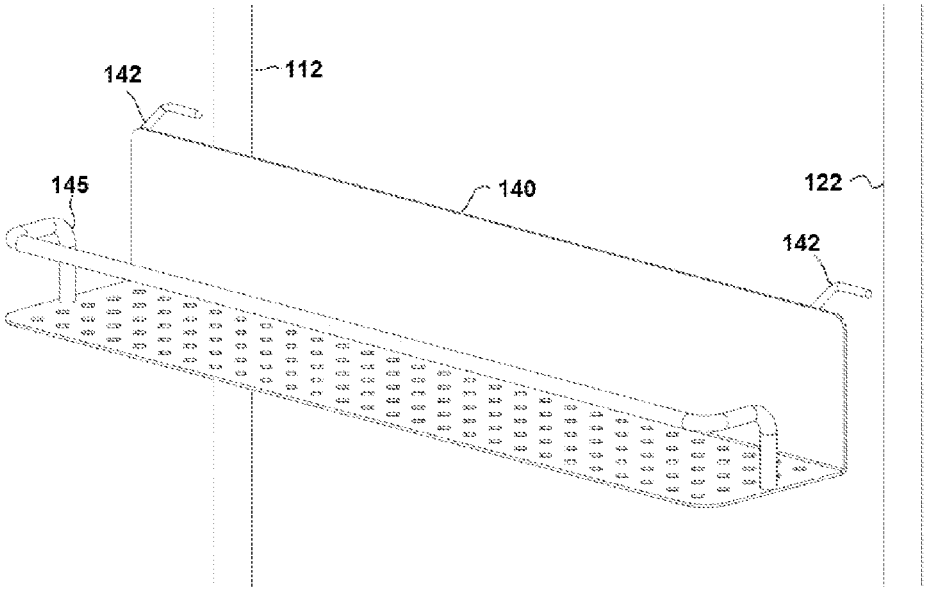
FIG. 7 is a perspective view of a component of the embodiment of FIG. 4.
Figure 8:
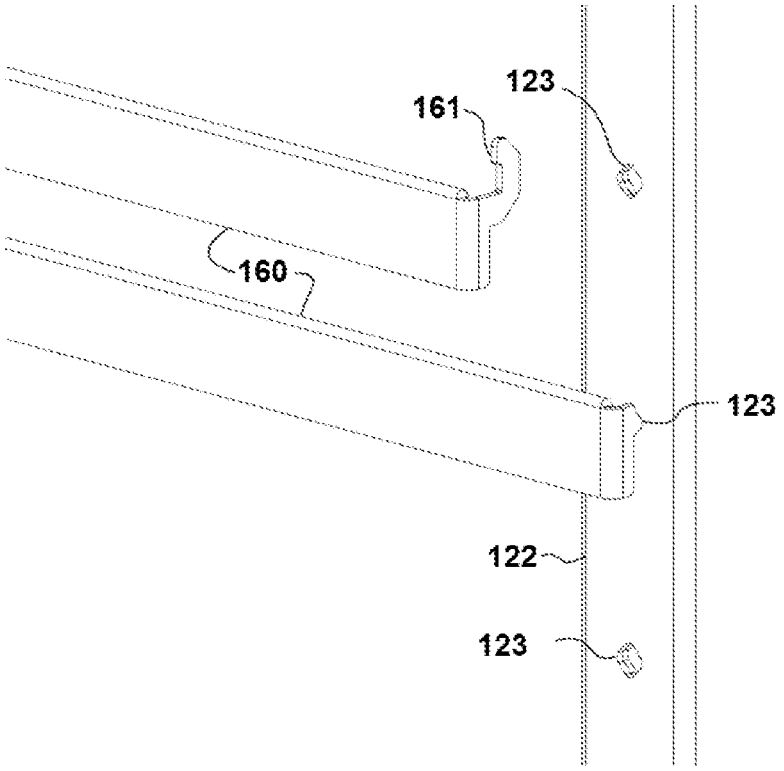
FIG. 8 is a perspective view of a component of the embodiment of FIG. 4.

In other embodiments, transverse member 140 with retaining bar 145 may comprise loops 141 as shown in FIG. 6 that can be used to hang transverse member 140 from vertical components 112 and 122. In still other embodiments, transverse member 140 with retaining bar 145 may comprise hooks 142 as shown in FIG. 7 that can be used to hang transverse member 140 from vertical components 112 and 122 and provide for easy removal and positioning of transverse member 140. FIG. 8 provides a detailed view of one configuration in which transverse member 160 can be coupled to vertical components 112 and 122. In this embodiment, transverse member 160 comprises a hook 161 that can be inserted into apertures 113 and 123 of vertical components 112 and 122. In FIG. 8, one example of transverse member 160 is shown installed, while a second example of transverse member 160 is shown before installation in order to view hook 161. In certain embodiments, transverse members 140 and 150 may comprise similar hook arrangements to allow coupling to vertical components 112 and 122. In particular embodiments, transverse members 140 and/or 150 may comprise coupling members (e.g. hooks, pins, etc.) that couple to transverse member 160. For example, transverse member 140 may comprise a hook that couples to the upper surface of transverse member 160. This can allow transverse member 140 to be removed by lifting up to disengage transverse member 140 from transverse member 160. Accordingly, transverse member 140 may be easily removed without removing items from transverse member 140.

Figure 9:
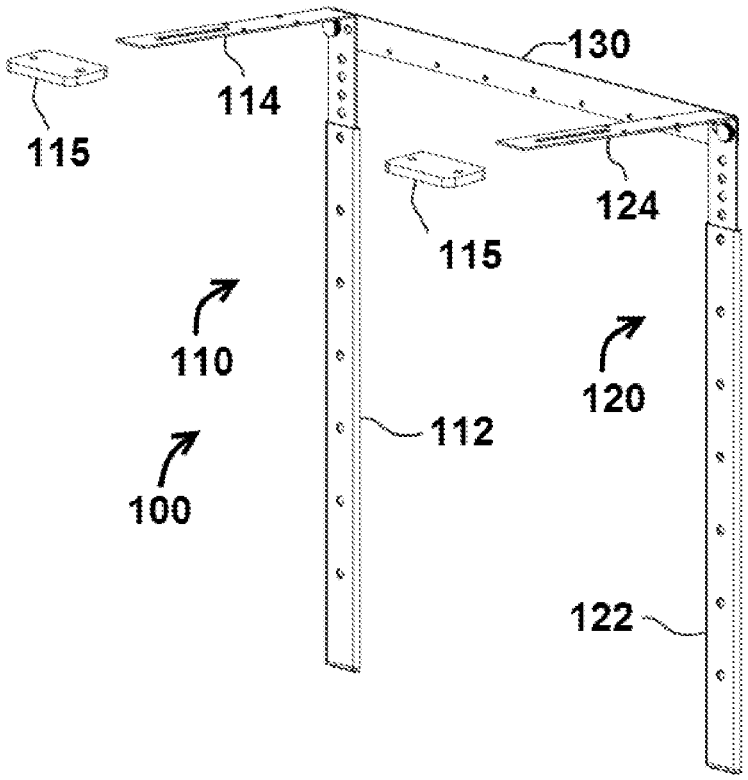
FIG. 9 is a perspective view of the embodiment of FIG. 1 with additional components.

Referring now to FIG. 9, another embodiment of storage device utilizes a pair of cleats 115 that may be attached to a bottom surface of a cabinet (e.g. surface 183 shown in FIG. 3) to retain lateral components 114 and 124. In certain exemplary embodiments, cleats 115 may be coupled to the cabinet in a manner that does not damage or penetrate the surface of the cabinet, including for example, adhesives. In other embodiments, cleats 115 may be coupled to the cabinet surface via screws or bolts if desired. Cleats 115 can be coupled to the cabinet surface such that lateral components 114 and 124 are retained between cleats 115 and a wall behind the cabinet. Accordingly, storage device 100 can be secured such that it is prevented from tipping away from the wall behind the cabinet.

Figure 10:
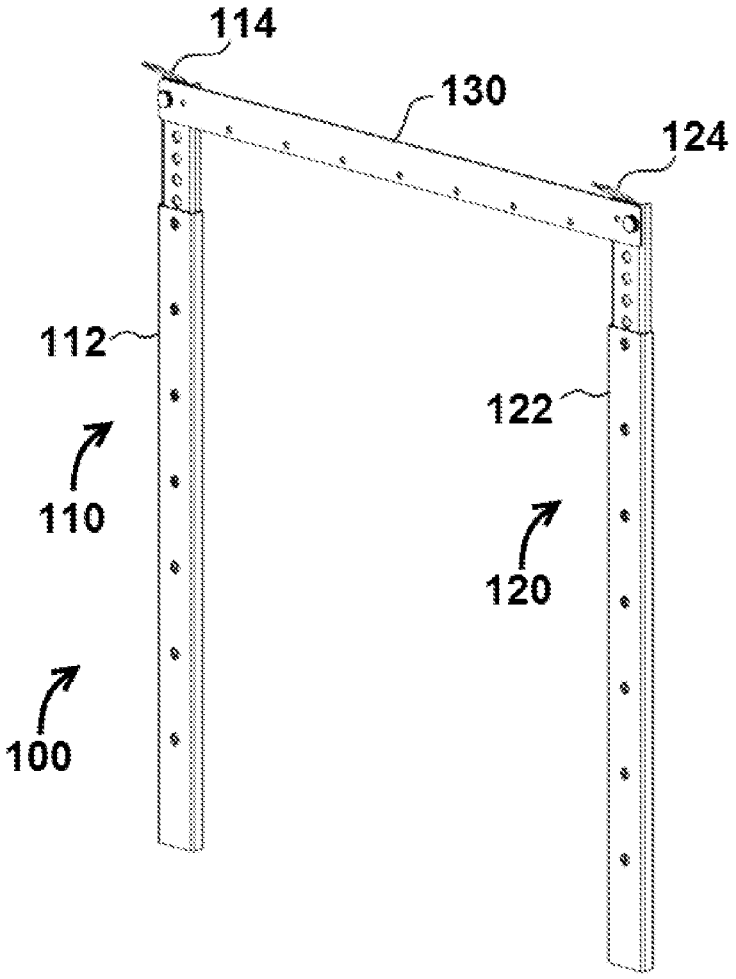
FIG. 10 is a perspective view of the embodiment of FIG. 1 with different lateral components for the support members.

Referring now to FIG. 10, storage device 100 comprises a different configuration with lateral members 114 and 124 that are flexibly coupled at an angle of approximately 45 degrees from vertical components 112 and 122. In addition, lateral members 114 and 124 are substantially shorter than those shown in previous embodiments. In this embodiment, lateral members 114 and 124 can engage a bottom surface of a cabinet (e.g. surface 183 shown in FIG. 3) and the friction between lateral members 114 and 124 can support storage device 100 and prevent it from tipping away from the wall. In certain embodiments, lateral members 114 and 124 can be made from rubber, plastic, metal or any material suitable for frictional engagement with the cabinet bottom surface. In particular embodiments, lateral members 114 and 124 may also utilize an adhesive to grip the cabinet surface.

Figure 11:
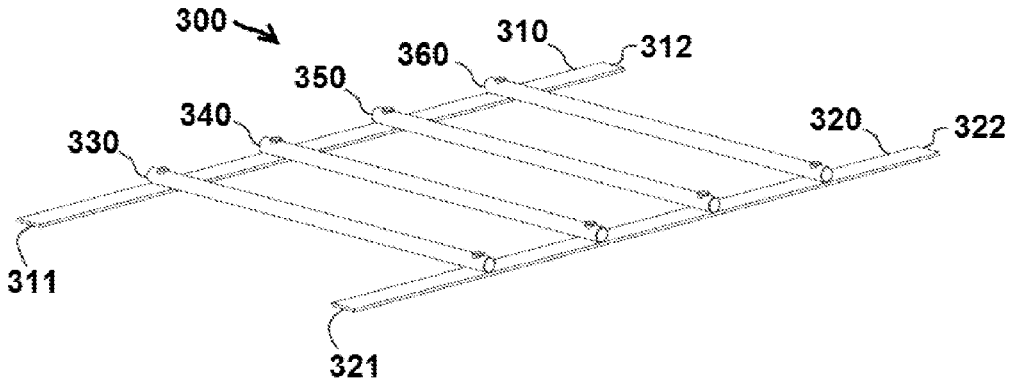
FIG. 11 is a perspective view of an embodiment of a storage device according to the present disclosure in an unfolded position.
Figure 12:
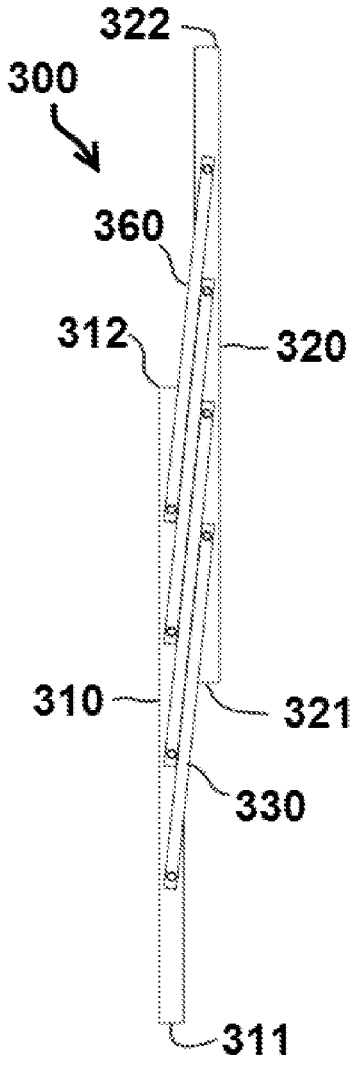
FIG. 12 is a top view of the embodiment of FIG. 11 in a folded position.

Referring now to FIGS. 11 and 12, a storage device 300 comprises support members 310 and 320 pivotally coupled to transverse members 330, 340, 350 and 360. FIG. 11 illustrates storage device 300 in an unfolded position, while FIG. 12 illustrates the device in a folded position. The folded position shown in FIG. 12 can provide for reduced packaging and shipping costs, as well as reduced storage space when the device is not in use. In the embodiment shown, support members 310 and 320 are shown in a linear position. Support members 310 and 320 are flexible such that they can be curved to fit, for example, in the space between a cabinet and countertop. In particular embodiments, support members 310 and 320 can be curved such that ends 311 and 321 are substantially perpendicular to ends 312 and 322. Accordingly ends 311 and 321 could be supported by a horizontal surface underneath a cabinet (e.g. a countertop) and ends 312 and 322 could be supported by a cabinet surface (e.g. a face frame of the cabinet or cleat). In certain embodiments, support members 310 and 320 may be adjustable in length to accommodate common variations in cabinet height and depth.

Figure 13:
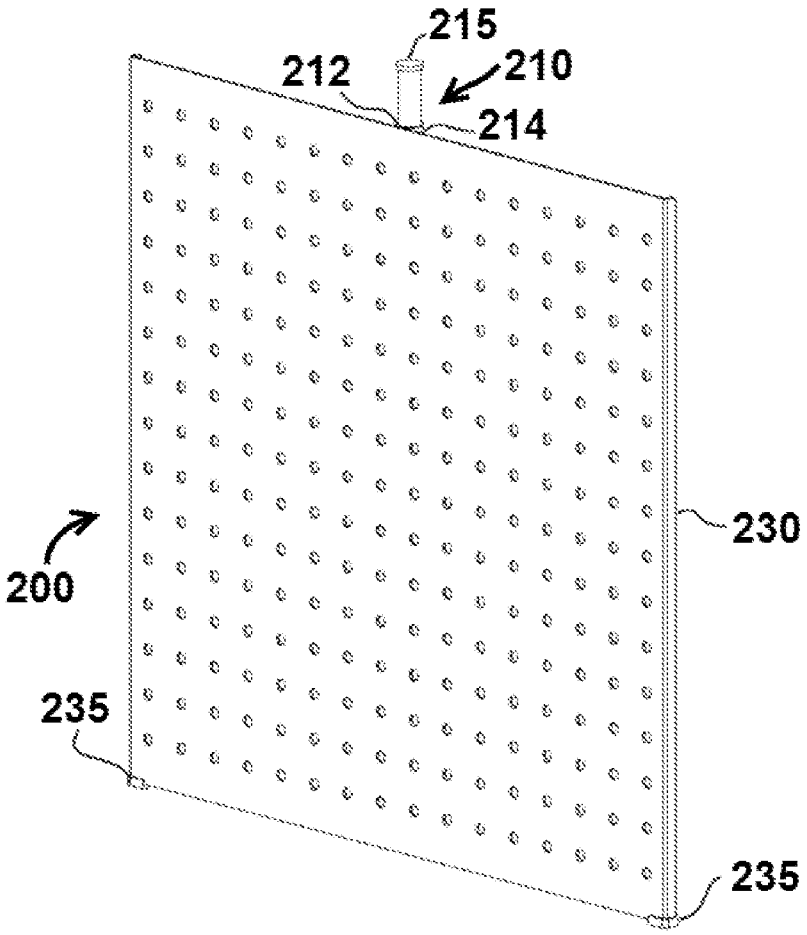
FIG. 13 is a perspective view of an embodiment of a storage device according to the present disclosure.
Figure 14:
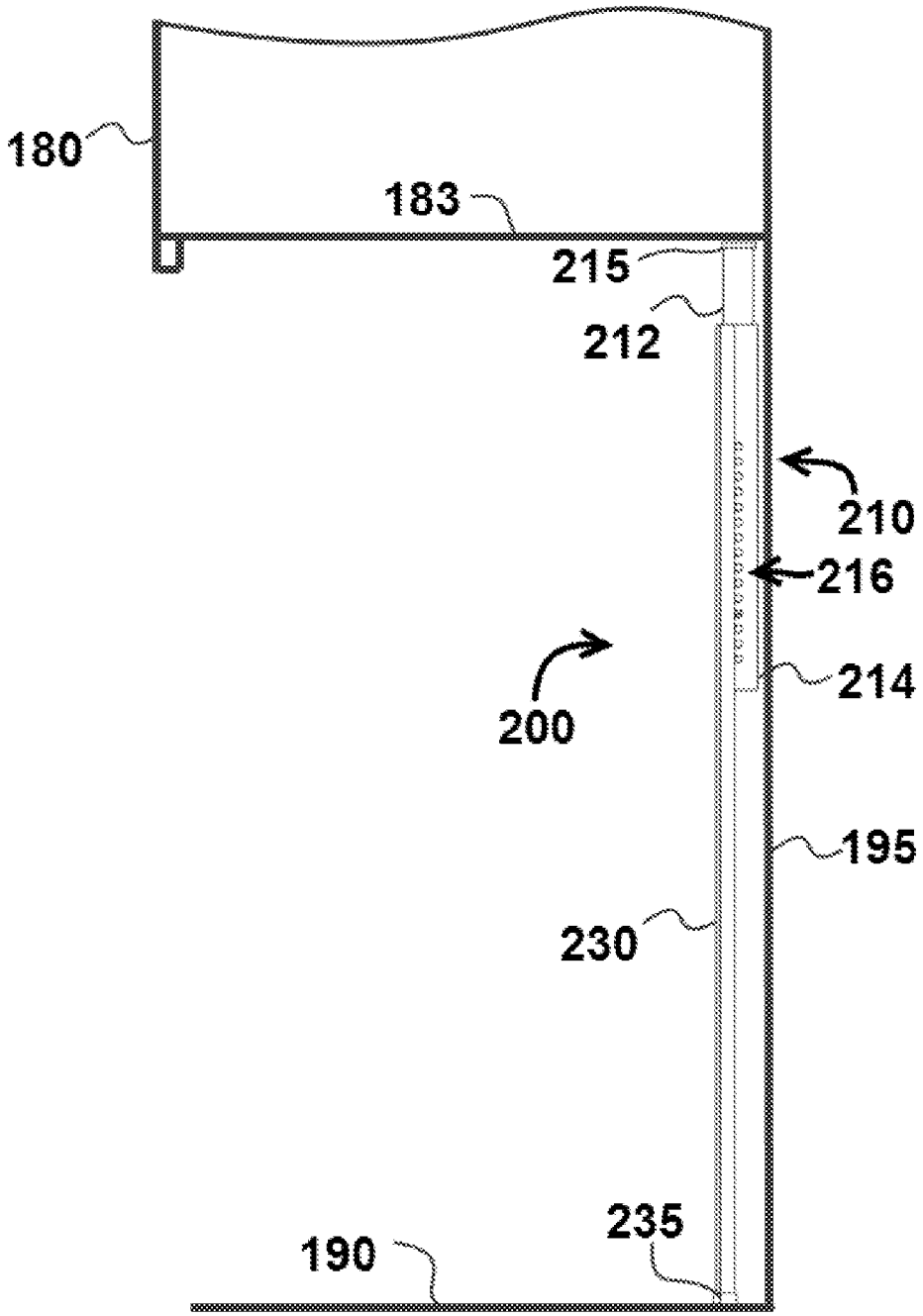
FIG. 14 is a side view of the embodiment of FIG. 13 during use.

Referring now to FIGS. 13-14 another embodiment of a storage device 200 comprises a transverse member 230 coupled to a support member 210. In the embodiment shown, support member 210 is located proximal to the center of transverse member 230. In this embodiment support member 210 comprises a gripping member 215 configured to engage bottom surface 183 of cabinet 180, while transverse member 230 comprises gripping members 235 configured to engage horizontal surface 190.

Storage device 200 can also be adjusted such that the height (e.g. the vertical distance between gripping members 235 and gripping member 215 in the orientation shown in the figures) can be varied. This can allow storage device 200 to be installed and supported in locations with different distances between cabinet 180 and horizontal surface 190. In the embodiment shown, this adjustment is accomplished by adjusting the length of support member 210. In this embodiment, support member 210 comprises an extension member 212 that is received by a tubular member 214 that is coupled to transverse member 230. Tubular member 214 and/or extension member 212 can comprise a plurality of apertures 216 that allow extension member 212 to be extended or retracted into tubular member 214. Extension member 212 can be fixed into the desired position in relation to tubular member 214 via a removable pin, spring-loaded fingers, threaded coupling, spring-loaded coupling, or other applicable configurations. Gripping members 215 and 235 can be made of a suitable compressible material (e.g., rubber, plastic, high density foam, etc.) to provide for positive engagement with cabinet 180 and horizontal surface 190 to support storage device 200 without damaging or penetrating surface 183 of cabinet 180 or horizontal surface 190. In certain embodiments, gripping members 215 and 235 may also include the use of a damage-free adhesive or cleat to retain support member 210 proximal to wall 195.

Various features and advantageous details are explained more fully with reference to the non-limiting embodiments that are illustrated in the accompanying drawings and detailed in the description contained herein. It should be understood, however, that the detailed description and the specific examples, while indicating embodiments of the invention, are given by way of illustration only, and not by way of limitation. Various substitutions, modifications, additions, and/or rearrangements will become apparent to those of ordinary skill in the art from this disclosure.

In the description contained herein, numerous specific details are provided to provide a thorough understanding of the disclosed embodiments. One of ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention. It is understood that for purposes of clarity, not all reference numbers are shown for every component visible in each figure.

It should be understood that the present devices and methods are not intended to be limited to the particular forms disclosed. Rather, they are to cover all modifications, equivalents, and alternatives falling within the scope of the claims. For example, support members or other components may be configured as rectangular tubes, C-channels, flat straps, etc.

The above specification and examples provide a complete description of the structure and use of an exemplary embodiment. Although certain embodiments have been described above with a certain degree of particularity, or with reference to one or more individual embodiments, those skilled in the art could make numerous alterations to the disclosed embodiments without departing from the scope of this invention. As such, the illustrative embodiment of the present devices is not intended to be limited to the particular forms disclosed. Rather, they include all modifications and alternatives falling within the scope of the claims, and embodiments other than the one shown may include some or all of the features of the depicted embodiment. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not to be interpreted as including means-plus- or step-plus-function limitations, unless such a limitation is explicitly recited in a given claim using the phrase(s) "means for" or "step for," respectively.

We claim:

1. A method of supporting a storage device, the method comprising:

engaging the storage device with a surface of a cabinet; and engaging the storage device with a horizontal surface underneath the cabinet, wherein:

the storage device does not penetrate the surface of the cabinet;

the storage device does not penetrate the horizontal surface;

the storage device comprises a pair of flexible support members each comprising a first end and a second end; and engaging the storage device with the surface of the cabinet and with the horizontal surface underneath the cabinet comprises curving the pair of flexible support members from a linear position such that the first end of each flexible support member is substantially perpendicular to the second end of each flexible support member.

2. The method of claim 1, wherein the surface of the cabinet is perpendicular to the horizontal surface.

3. The method of claim 2 wherein the surface of the cabinet perpendicular to the horizontal surface is a face frame of the cabinet.

4. The method of claim 1 wherein the surface of the cabinet is parallel to the horizontal surface.

5. The method of claim 1 wherein:

the storage device comprises a transverse member coupled to the pair of flexible support members;

the transverse member comprises a members comprises a plurality of apertures; and each aperture in the plurality of apertures is configured in a square shape with a corner of the square shape at a lowermost point of each aperture.

6. The method of claim 5 wherein the pair of flexible support members are pivotally coupled to a plurality of transverse members.

7. The method of claim 6 wherein the pair of flexible support members are adjustable in length.

8. The method of claim 6 wherein a first transverse member of the plurality of transverse members comprises a plurality of apertures and wherein each aperture in the plurality of apertures is configured in a square shape with a corner of the square shape at a lowermost point of each aperture.

9. The method of claim 8 wherein:

the first transverse member comprises a first surface and a second surface;

a first aperture in the plurality of apertures extends through the first transverse member from the first surface to the second surface at an angle of approximately 10 degrees from horizontal when the first surface and second surface of the first transverse member are vertical.

10. The method of claim 9 wherein the first aperture is configured to receive a circular neck of a bottle and support the bottle such that the bottle is substantially horizontal.

11. The method of claim 1 further comprising engaging the storage device with a wall extending between the cabinet and the horizontal surface.

* * * * *